US006016756A

United States Patent [19]

McMahon et al.

[11] Patent Number: 6,016,756

[45] Date of Patent: Jan. 25, 2000

[54] KITS AND ASSEMBLIES INCLUDING PLASTIC BRACKETS FOR ATTACHING LEGS TO READY-TO-ASSEMBLE DECORATOR TABLES AND FURNITURE

[75] Inventors: Gregory A. McMahon; Steven B. McMahon, both of Columbus, Ohio

[73] Assignee: BMC Group II, Inc., Philadelphia, Pa.

[21] Appl. No.: 09/015,489

[22] Filed: Jan. 28, 1998

[51] Int. Cl.[7] ..... A47B 3/06

[52] U.S. Cl. ..... 108/158; 108/156

[58] Field of Search ..... 108/158, 156, 108/157.1, 159, 158.11, 186; 312/351.3; 248/188; 297/440.1; 403/187, 198, 265, 263

[56] References Cited

U.S. PATENT DOCUMENTS

| | | | |
|---|---|---|---|
| 2,546,439 | 3/1951 | Green | 108/156 |
| 2,965,241 | 12/1960 | Derman | 248/188 |
| 4,199,124 | 4/1980 | Tachida | 248/188 |
| 4,869,551 | 9/1989 | Lathers | 297/440.1 |

FOREIGN PATENT DOCUMENTS

| | | | |
|---|---|---|---|
| 2328084 | 12/1974 | Germany | 403/265 |
| 613915 | 12/1960 | Italy | 297/440.1 |
| 614517 | 12/1960 | Italy | 248/188 |
| 906352 | 9/1962 | United Kingdom | 297/440.1 |

*Primary Examiner*—Janet M. Wilkens

*Attorney, Agent, or Firm*—Porter, Wright, Morris & Arthur, LLP

[57] ABSTRACT

A decorator table kit includes a table top and a plurality of table legs, each attached by a molded bracket that is bonded to the underside of the table top. The bracket includes an angled socket for reception of a threaded end segment of a table leg and is secured through a baseplate to the table underside; a support shoulder or one or more ribs extend from the outer circumference of the socket to the baseplate. Kits with three or four legs are preferred.

10 Claims, 3 Drawing Sheets

KITS AND ASSEMBLIES INCLUDING PLASTIC BRACKETS FOR ATTACHING LEGS TO READY-TO-ASSEMBLE DECORATOR TABLES AND FURNITURE

FIELD OF THE INVENTION

This invention relates to decorator tables that are known to take the form of different shapes (round, octagonal, half-round, rectangular, oval, for example) and sizes to suit virtually any decor and to products of the ready-to-assemble furniture industry and to kits for and assemblies of such products. The invention provides a leg attachment device which is much easier to assemble during the manufacturing process than steel units now in wide use and achieves quick, sturdy and reliable, manufacturing and assembly techniques.

BACKGROUND OF THE INVENTION

The purpose of this invention is to provide a stronger and more stable method to attach table legs to decorator tables while at the same time doing so at a manufacturing cost that is comparable to previously available technology. As noted, decorator tables take the form of many different shapes and virtually any size.

It is an object of the present invention to provide a ready to assemble decorator table that would be perceived as superior quality by the retail consumer, and to provide the ready-to-assemble furniture industry with a leg attachment device that is easier to attach during the manufacturing process than steel units now in wide use. As such, the plastic bracket system may also be used as an attachment method for legs/supports to other types of home furnishings requiring quick, sturdy and reliable, manufacturing and assembly techniques.

Prior to the invention of the plastic leg mount bracket described herein, the standard method used for attaching legs to a decorator table was via a stamped steel bracket with a machine screw thread for mounting the leg. The leg (which, in general, is from about 0.75 inches in diameter to about 1.5 inches in diameter, more or less, depending upon application) has a double end hanger bolt in one end. One end of the hanger bolt is a machine thread to match the leg plate thread and the other is a wood screw thread. The wood screw thread end is threaded into the end of the leg, and the machine screw thread mounts the leg to the bracket/table top.

In the prior art installation, the steel brackets are attached to the table top by self tapping wood screws. This design system results in a table that has reasonable stability and rigidity. Because a decorator table product is price sensitive, other fastening techniques using larger diameter legs, heavier steel mounting plates, longer studs or larger that may result in a stronger table are not economically feasible.

The disadvantages of these prior art methods, techniques or devices are in three categories related to (1) manufacturing assembly (2) performance of the final end consumer purchased product and (3) manufacturing cost considerations. As to manufacturing and factory assembly, the steel bracket technique involves the installation of three or more screws to attach the bracket to the underside of the table. This process consumes a significant amount of expensive manufacturing time. In addition, the assembly includes wood screws that must be properly tightened into the wood substrate table to be fully effective. Defective assemblies associated with stripped wood screws are not an uncommon failure which is eliminated by the new plastic bracket system of the invention. As to product performance, although it has been used for many years, the leg mounting technique utilizing the wood leg, steel stud, steel bracket and steel mounting screws has performance limitations when compared to the system of the invention. The torsional stability of the metal bracket system is inferior to that of the plastic bracket of the invention. In the metal bracket prior art, the interface between the planar diameter of the screwed in flat end face of the leg and the receiving bracket is not large enough to effectively control the side to side movement of the leg when a side load is placed on the leg. As to manufacturing cost considerations, the steel bracket system requires a labor intensive process for assembly of the bracket to the table top. While the actual cost of the system of the invention is approximately equivalent to the cost of metal bracket system, without considering the improved quality performance of the invention, the invention results in a more cost effective assembly of a bracket to the table top and results in a superior product.

The invention is explained below with reference to the description of the preferred embodiment taken in conjunction with the drawings in which:

DESCRIPTION OF THE PREFERRED EMBODIMENT

Figure 1:
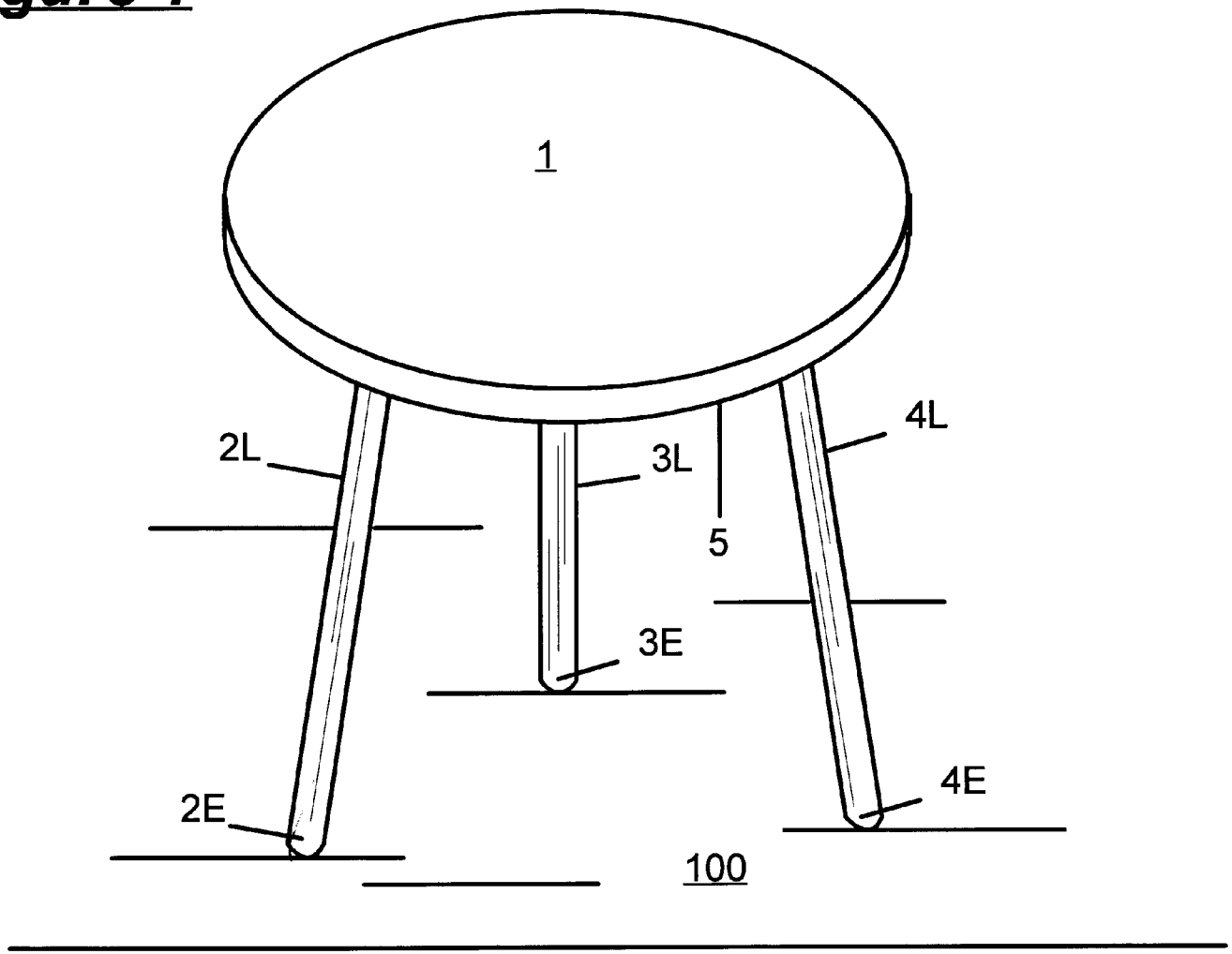
FIG. 1 shows a three legged decorator table.

This invention relates to a molded bracket that functionally replaces a metal stamping plate type bracket conventionally used to attach legs to ready-to-assemble tables and furniture, and to kits and assemblies formed therewith. A table leg or other applicable furniture part is threaded into female threads molded within a socket or post of the bracket. The bracket is attached to the underside of the table or other furniture piece by a hot-melt glue or other adhesive system capable of bonding the respective plastic bracket and the typical fiberboard and particle board table top types of materials involved. Because a significant amount of the bracket rigidity is derived from the base baseplate section of the molding, it is important to apply the adhesive in a manner that fully covers at least the entire area (footprint) of the bracket baseplate corresponding to the area of the baseplate occupied by the leg socket on the opposite side of the baseplate.

The kit includes a table top and a plurality of table legs, each attached by a bracket to the underside of the table top. The legs can be wood, formed polymer, metal or polymer tubing or the like. The bracket for each leg is a molded bracket attached to the table top underside and includes a socket for reception of an end segment of the table leg. The socket includes internal threads capable of receiving external threads integrally formed on the outer circumference of the leg at one end section thereof. The opposite end section of the leg may be formed in an approximate hemispherical shape (shown at 2E, 3E and 4E in FIG. 1) to assist in stabilization of the table on a floor surface (shown at 100 in FIG. 1). The bracket has an integral baseplate from which the socket extends at a predetermined angle and the baseplate is preferably adhesively secured to the table underside. The bracket may further include a support brace between the outer periphery of the socket and the baseplate in the form of one or more ribs or a circumferential shoulder. Viewing the bracket from the table center, the rib braces extend between the baseplate and the outer periphery of the socket at an angled side of the socket that extends from the baseplate at an angle of more than 90° from vertical, or if the ribs are on an outside section of the bracket, the rib extends between the baseplate and the outer periphery of the socket at an angle of less than 90° from vertical. A hot melt adhesive is preferred to bond and secure the brackets to the table top; preferably the adhesive provides an adhesive interface between the baseplate and table underside extending over approximately 100% of the surface area of the baseplate. A bead section at the perimeter of the baseplate evidences full surface coverage and adds additional rigidity.

In the kits, a table top to which three brackets are secured and three legs for insertion into the sockets of the brackets may be provided in a ready to assemble package, or a table top to which four brackets are secured and four legs for insertion into the sockets may be provided. The table top shape is discretionary. The internal threads of the socket narrowingly taper from the socket opening to the socket bottom and more rigidly maintain the threaded end sections of the legs that are screwed therein. The internal angle of taper is several degrees, typically less than about 5°. The socket may extend outward (from the table center) from the baseplate at an angle in the range of from about 5° to about 20° with respect to vertical. With a top of 20 inches in diameter, an angle of 12.5° is useful with legs about 24 to 25 inches long. The legs may be longer or shorter; with larger or smaller table tops, leg length may vary.

Figure 2:
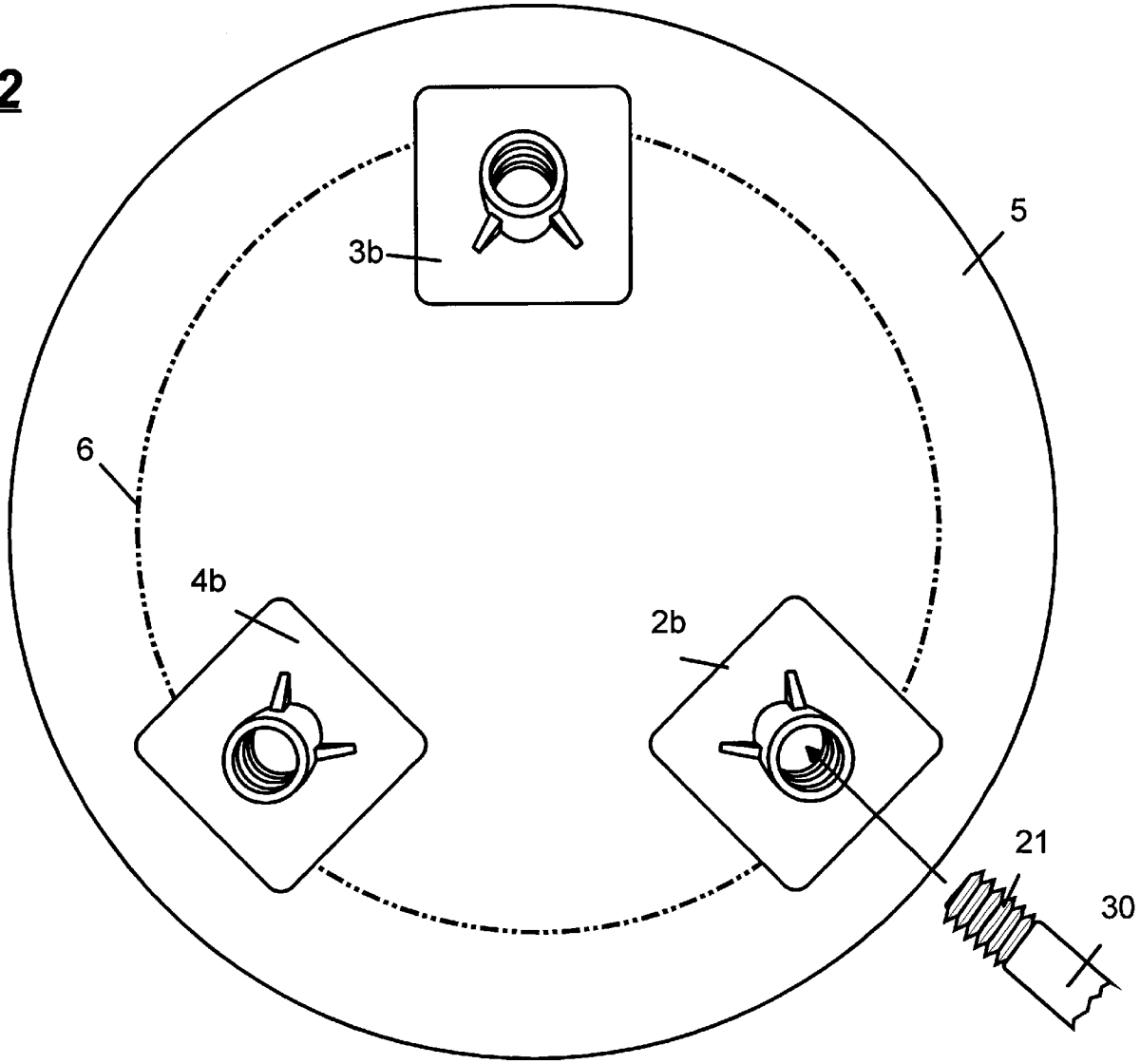
FIG. 2 shows the underside of the three legged decorator table and the brackets that receive the legs.
Figure 3:
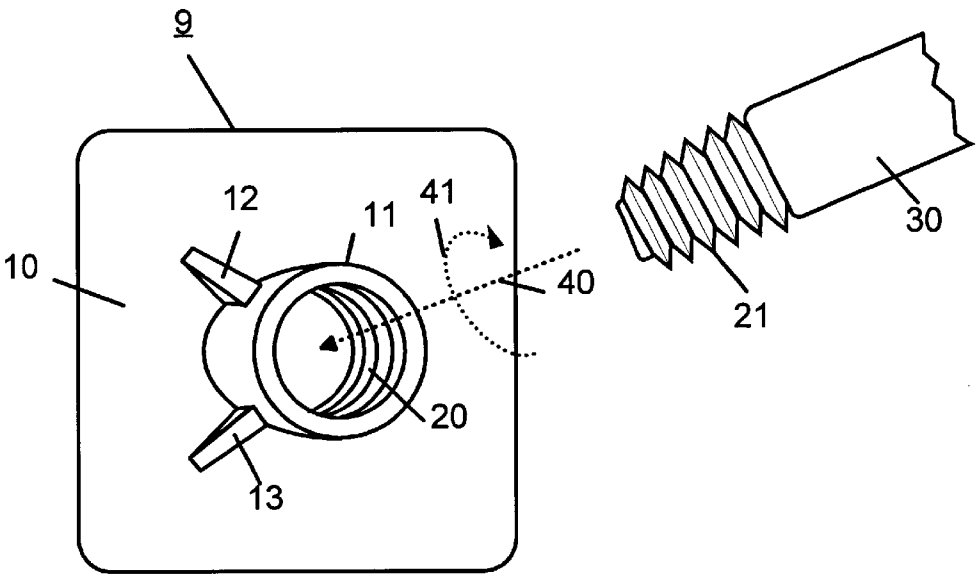
FIG. 3 shows in detail the bracket/table leg relationship.

In the drawings, FIG. 1 shows a decorator table 20" round by 25½" tall used with a 70" diameter table linen supplied in a kit for subsequent assembly. The kit includes a table top 1, and three legs 2L, 3L and 4L (of essentially equal length) for attachment to the underside 5 of the table top. With reference to FIG. 2, the underside of the table top includes glued thereto at 120° intervals, spaced apart at diameter of a circle 6 within and concentric with the diameter of the top, three plastic injection molded brackets 2*b*, 3*b* and 4*b* correspondingly adapted to receive the legs 2L, 3L and 4L. In a table with four legs, the brackets are angled outwardly from a comparable mid-section of the table toward corner points of a rectangular array. As shown in greater detail in FIG. 3, the identical brackets 2*b*, 3*b* and 4*b* indicated as 9 in the figure, include a base plate 10 in an integral molding that includes a socket 11 having internal threads 20 and one or more side braces or support members 12 and 13. The socket is angled with respect to the planar underside of the table, in the example at 12.5° outward from the vertical axis of the table center. In FIG. 3 the internal threads 20 of the socket are adapted to cooperate with complementary external threads 21 at the ends of the supplied legs indicated as 30. As shown in FIG. 3, the leg end 30 is inserted 40 into the socket 11 and screwed in by rotation 41. The full diameter of the leg is used resulting in greater torsional strength and rigidity in the table as well as simplified manufacture and the reduction of parts. In the 20 inch table of the example, the baseplate segment of the socket is approximately 2.75 inches square; the socket is adapted to receive a leg of a nominal 0.875 inch diameter and extends approximately 1.0 inches from the baseplate at the 12.5° angle. Nominal thickness of the baseplate, socket cylinder and support ribs forming the bracket is about 0.125 inches. Conventional injection molding polymers such as ABS or polystyrene and alloys and blends may be used in forming the bracket and will have engineering properties determined by factors such as load, desired rigidity and cost considerations. In the example, the hot melt adhesive used between the bracket and fiberboard top is compatible with both materials and has an "open time" of from about 20 to 40 seconds; 7 grams of adhesive per bracket will provide suitable coverage. Other varied adhesives may be used.

The improved rigidity is derived from having the table leg externally threaded in order to fit into the threaded female post or socket of the bracket. By using a slightly tapered design on the internal thread 20 of the bracket post 11, a wedging effect is provided for the externally threaded leg into the center post and a more rigid connection results. An optional correspondingly slight taper on the leg end 30 is shown in the leg of FIG. 3. The encapsulating effect of grabbing the leg over the entire length of the thread results in an attachment that provides significantly more flexing rigidity (referred to as torsional rigidity from this point forward) when compared to a threaded steel hanger bolt mounted to a steel plate and then to a wood leg.

Figure 4:
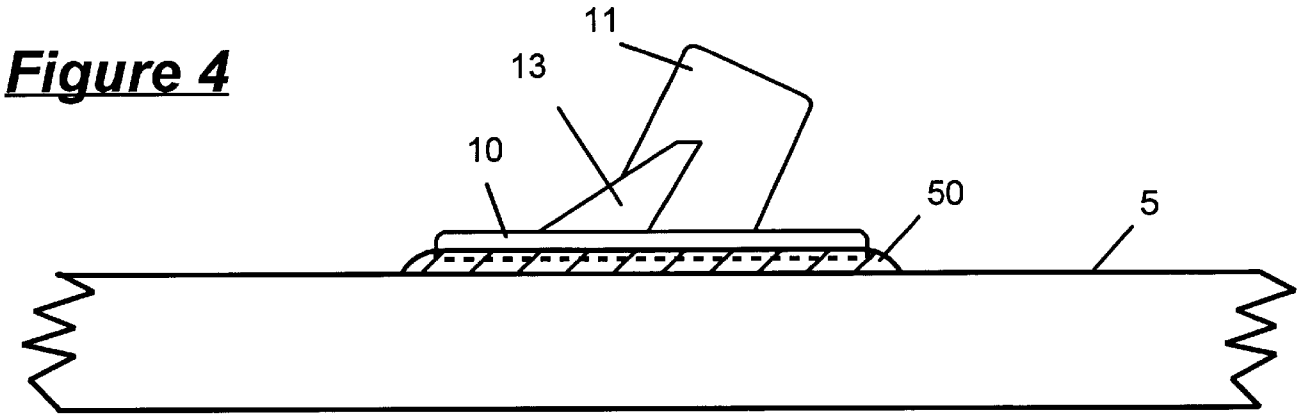
FIG. 4 shows the bracket baseplate relationship with the table underside.

In the prior art steel plate system, the pivoting action of the small footprint of the leg on the steel plate gives little resistance to movement and the steel plate either deflects or deforms (depending upon the degree of force applied to the leg). On the other hand, when torsional stress is applied to the design described herein, the leg is held firmly within the bracket and the deflecting stress is passed directly onto the base of the bracket (where the post meets the base). Proper reinforcement of this area of the bracket with ribbing at one or more positions, such as the two ribs shown at 12 and 13 in FIG. 3 is very important. Three ribs spaced at 120° intervals or four ribs at 90° intervals are also useful and a fully circumferential shoulder at the post/socket/baseplate interface may also be employed. It is also in this area that it is critical that the base of the bracket immediately under the post be thoroughly glued to the substrate underneath. FIG. 4 shows a bracket baseplate 10 in a glue or adhesive interface 50 with the table underside 5. The glue surface between the table and bracket extends at least the area of the socket on the opposite side of the baseplate and preferably the full area on the bracket baseplate with respect to the corresponding area segment of the table underside. A slight overrun of the glue beyond the perimeter of the baseplate will usually evidence 100% glue coverage between the surfaces. When properly installed, lab tests performed show a minimum of 25% and as much as a 100% increase in the load capacity of the joint before failure occurs when compared to a prior art metal bracket design. (A failure is defined as a permanent deformation of the leg plate, detachment of the leg plate from the substrate or failure of the leg/leg stud.)

In addition to hot melt systems, other types of mechanical fastening systems may also be used. Staples, screws or nails may also be used to replace or augment the hot melt glue system.

The invention results in a finished consumer product that is stronger than equivalently constructed tables with a metal bracket system and is more torsionally stable than the steel bracket system. The invention involves only two parts, leg and bracket per attachment point plus glue in contrast with the six parts per attachment point required for the steel bracket system: leg, stud, bracket and three screws. This reduction in parts logically results in fewer inventory parts, fewer opportunities for part failures and significantly lower assembly time and lower manufacturing cost.

The invention also has adjustable leg length capability to allow for minor differences in leg length or floor unevenness when dealing with four-leg table applications. Steel bracket systems have no way to accomplish this.

The invention is also adaptable to highly automated high speed assembly techniques using robotics and other state of the art procedures. Prior technology steel mounting plates using several screws and a leg stud will require a significantly more complicated automation procedure. Assembly times for an automated version of the steel plate technology would not be as fast or economically feasible.

The principal use for the brackets will be used initially to act as leg attachment devices in a decorator table assembly and kit. As discussed previously, these tables can take the form of many different shapes and sizes and can be used to produce tables in a highly automated environment resulting in a superior quality table at a lower manufacturing cost when compared to the previous steel mounting plate technology. Eventually, the bracket may be marketed to other areas of the fixture hardware industry, and sizes, general dimensions, attachment angles, color or any other parameter can be adjusted to meet the specific needs of the end use.

The advantages of the table bracket are demonstrated in the following test results:

Working with 25 plastic brackets produced from a prototype injection molding die and machine, ultimate attachment strength of the leg/plastic bracket system were compared to 25 steel mounting plate/leg assemblies. Tests were performed on a variety of substrates including (1) medium density fiberboard (2) standard grade particle board (3) low grade, sub-standard density and internal bond particle board.

The results showed an ultimate strength between 25% and 100% stronger for the plastic bracket system when compared to the steel bracket system. The quality of the substrate is important; the plastic bracket system relies more upon the internal bond (IB) of the board than does the steel bracket system with regular mounting screws. When the hot melt glue is properly applied at the correct temperature and a uniform bond is formed, the poorest substrate performance (although still 25% stronger than the best performing steel bracket system) was found to be low grade, sub-standard density particle board.

When quantifying the strength performances, the mode of failure for metal bracket systems was either (1) detachment of the bracket from the table due to screws pulling out of the substrate (2) breakage of the leg or pull out of the hanger bolt from the leg or (3) permanent deformation of the steel bracket making it unsuitable for further use.

The mode of failure associated with the plastic bracket system was in every case (except one noted below) detachment of the bracket from the substrate. The internal bond (IB) of the board was the ruling parameter. In one case, the attachment strength was so strong that the bracket did not break loose from the substrate, but the resistive torque presented by the bracket system resulted in breaking the one inch diameter wooden leg in two pieces two inches above the bracket.

The above tests were quantified by pulling at a 90 degree angle to the table leg at a distance of 25 inches from the bracket. The resistive force was measured and torque was calculated.

In addition to the quantitative numbers discussed above, a subjective and qualitative evaluation associated with the overall rigidity of the table indicated that the plastic bracket system is more rigid and resistant to "wiggling" or other torsional upsetting forces than a steel bracketed table.

What is claimed is:

1. A ready to assemble decorator table kit comprising:

a plurality of legs, each leg having an externally threaded end;

a plurality of separate brackets corresponding in number to the plurality of legs, each of said brackets being molded from synthetic resin material integrally formed into a baseplate, an internally threaded, leg-receiving socket projecting outwardly from the baseplate, said socket being adapted to receive therein the externally threaded end of one of the plurality of legs, and at least one support brace extending between the baseplate and socket;

a table top having an undersurface; and an adhesive composition securing the baseplate of each of the brackets directly to the undersurface of the table top, said brackets being disposed in spaced and free-standing relation to one another on said undersurface.

2. The kit of claim 1, wherein said at least one support brace extending between the baseplate and socket comprises a rib extending from the baseplate to an outer surface of the socket.

3. The kit of claim 2 wherein each of said brackets includes a plurality of ribs extending from the baseplate to the outer surface of the socket.

4. The kit of claim 1 including narrowingly tapered threads at the externally threaded end of each of the legs.

5. The kit of claim 1 wherein each of the legs is formed with an approximately hemispherical configuration at an end opposite the externally threaded end.

6. The kit according to claim 1, wherein on each of said brackets the socket projects outwardly from the baseplate at a nonperpendicular angle relative to at least one plane of said baseplate.

7. The kit according to claim 1, wherein the adhesive composition is disposed between the undersurface of the table top and a surface opposite the socket on the baseplate of each of the brackets.

8. The kit according to claim 7, wherein the adhesive composition covers substantially the entire surface opposite the socket on the baseplate of each of the brackets.

9. The kit according to claim 8, wherein the adhesive composition defines a bead disposed outwardly of at least one perimeter edge portion of the baseplate on each of the brackets.

10. The kit according to claim 1, wherein three of said brackets and three of said legs are provided.

* * * * *